US005317946A

United States Patent [19]

Hoshino

[11] Patent Number: 5,317,946

[45] Date of Patent: Jun. 7, 1994

[54] BEATER STRUCTURE FOR A DRUM PEDAL

[75] Inventor: Yoshiki Hoshino, Aichi, Japan

[73] Assignee: Hoshino Gakki Co., Ltd., Japan

[21] Appl. No.: 916,888

[22] Filed: Jul. 20, 1992

[30] Foreign Application Priority Data

Dec. 16, 1991 [JP] Japan ..... 3-110558[U]

[51] Int. Cl.[5] ..... G10D 13/02

[52] U.S. Cl. ..... 84/422.1

[58] Field of Search ..... 84/422.1, 422.2, 422.3, 84/422.4

[56] References Cited

U.S. PATENT DOCUMENTS 3,151,518 10/1964 Zarcone et al. ..... 84/422.1
3,316,792 5/1967 Ippolito ..... 84/422.1
3,411,395 11/1968 Hanes ..... 84/422.1
4,023,461 5/1977 Brandolino ..... 84/422.1

*Primary Examiner*—Michael L. Gellner
*Assistant Examiner*—Cassandra Spyrou
*Attorney, Agent, or Firm*—Ostrolenk, Faber, Gerb & Soffen

[57] ABSTRACT

A beater for a drum pedal. A beater rod is pivotably supported at a first axis on a base. A beater body at the other end of the beater rod is swingable with the beater rod to beat a drum head. The beater body is supported to be freely adjustable in its orientation around a second axis defined by a holding shaft supported on the beater. The second axis is parallel to the first axis of the rod. The beater body may be fixed at a selected orientation around the holding shaft selected to cause the beater body to strike the drum head at a desired orientation.

8 Claims, 9 Drawing Sheets

BEATER STRUCTURE FOR A DRUM PEDAL

BACKGROUND OF THE INVENTION

The present invention relates to the structure of a beater for a drum pedal and particularly to the support for the beater body to enable optimum sound production.

An example of an ordinary drum pedal 100 is shown as FIGS. 10 and 11. The drum pedal 100 comprises a beater 110, an operating part 120 and a pedal 130. The pedal 100 is fixed to a bass drum 140 by a fixing member 105, such as a known clamp. The drum pedal has a base, which is connected to a support 102. A spring 103 returns the beater to its retracted position.

The beater 110 comprises a rod 111 and a main beater body 112 on the rod. The rod 111 is fixed to the beater rotary shaft 121 of the operating part 120. The main beater body 112 is made of felt. The rod 111 runs through the body 112 and the body 112 is installed at the tip of the rod 111 by a nut 113.

The operating part 120 is comprised of the horizontal beater pivot shaft 121, a wheel 122 mounted on and rotatable with the shaft 121 and a chain 123 trained on the wheel 122 and operable to rotate it. The beater pivot shaft 121 is supported horizontally and freely rotatably at the top of the support 102. The rod 111 and the wheel 122 which rotates integrally with the rod 111 are provided on the shaft 121.

The wheel 122 comprises a sprocket or a partial sprocket, and the chain 123 has an end which is fixed to the wheel 122 and is wound on its outer periphery. The other end of the chain 123 is connected to the free swinging tip of a foot pedal 131 of the pedal 130. As the foot pedal 131 is stepped on, the chain 123 is pulled down, which rotates the wheel 122 and the rod 111, thereby causing the main beater body 112 to beat the drum head 141 of the bass drum 140.

The main beater body 112 of the beater 110 beats against the drum head 141 only at a point on one edge of the beater body, as shown by the broken line in FIG. 11. As a result, the impact of the beating is weak, and it is difficult to obtain a powerful sound. This usually undesirable situation is normally compensated for by slightly tilting the bass drum 140 so that the drum head 141 may become parallel with the beating face of the beater body or by changing the shape of the main beater body 112 of the beater so that the drum head may be struck by the entire beating surface. Although such a method is capable of obtaining the desired beating effect on the surface of the drum head at a position in a restricted height range, it requires readjustment when the position of the drum has been changed.

In some combinations with the drum, furthermore, the beating does not necessarily take place on the surface.

SUMMARY OF THE INVENTION

It is an object of the present invention to provide a beater on a drum pedal, which beater beats the drum head over the entire beater surface irrespective of the positions or combinations of the drums.

A beater for a drum pedal has a main beater body which beats the drum head. The beater body is rotated by operation of the pedal. The rod swings or pivots around a first axis with reference to a support base. The main beater body is angularly swingable or adjustable in its orientation around a second axis transverse to the rod and is then fixed at a selected pivot orientation around the axis. The second axis is generally parallel to the first. Fixing means hold the beater body at a selected pivot orientation with respect to the rod. The fixing means are detailed below.

Other objects and features of the invention are explained below with reference to the drawings.

DESCRIPTION OF THE PREFERRED EMBODIMENTS

Figure 1:
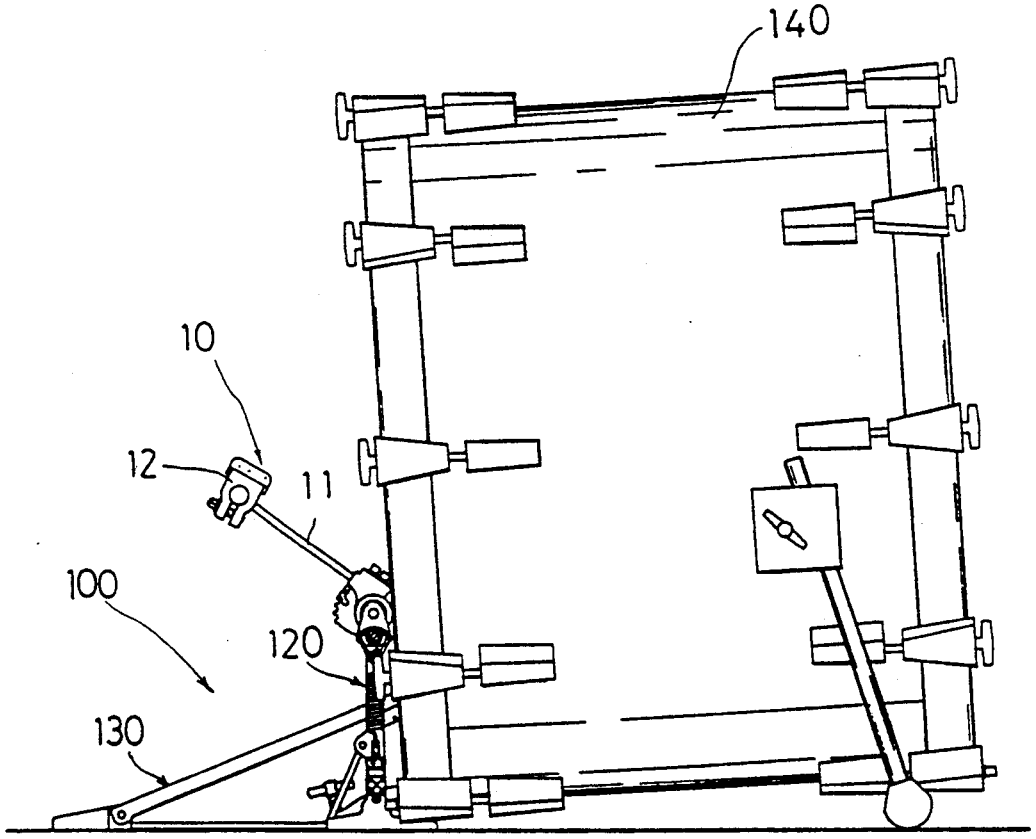
FIG. 1 is a side view of a drum pedal with a first example of the beater of the invention associated with a bass drum.
Figure 2:
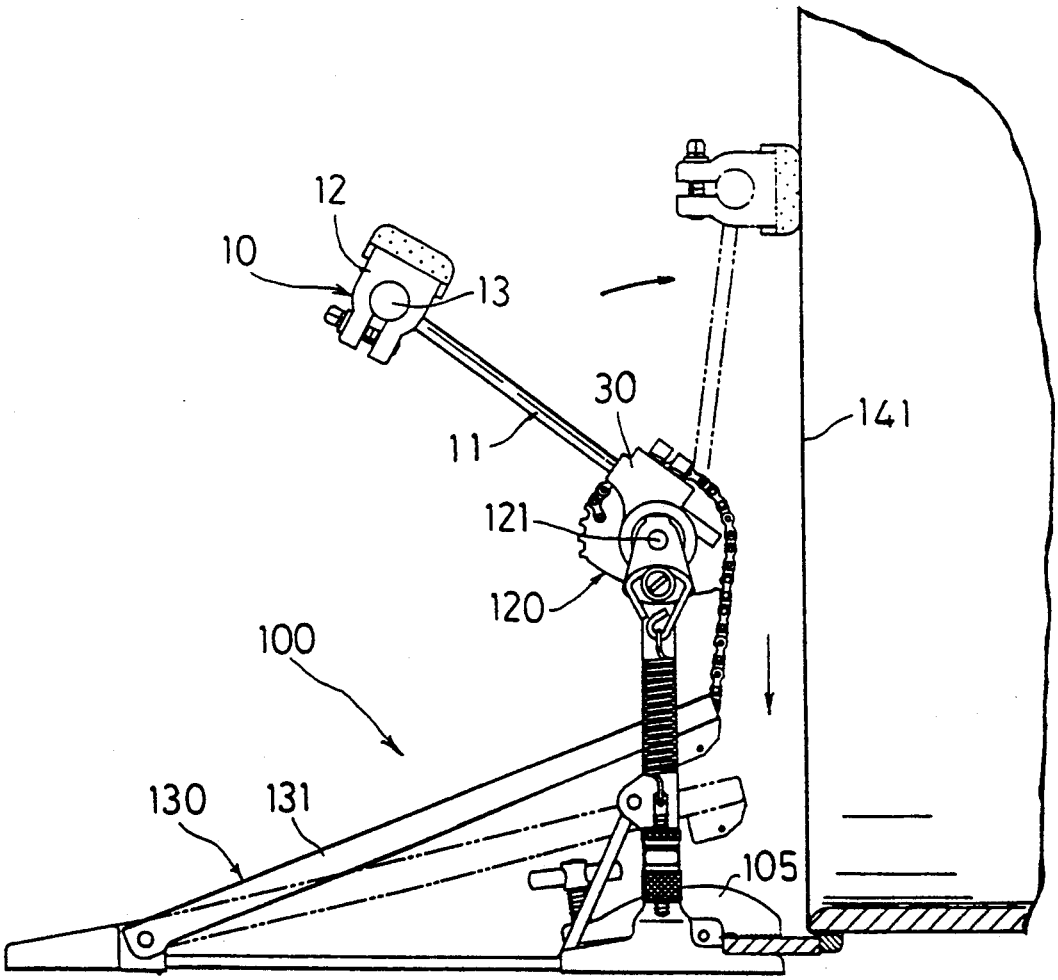
FIG. 2 is an expanded view of the beater of FIG. 1.
Figure 10:
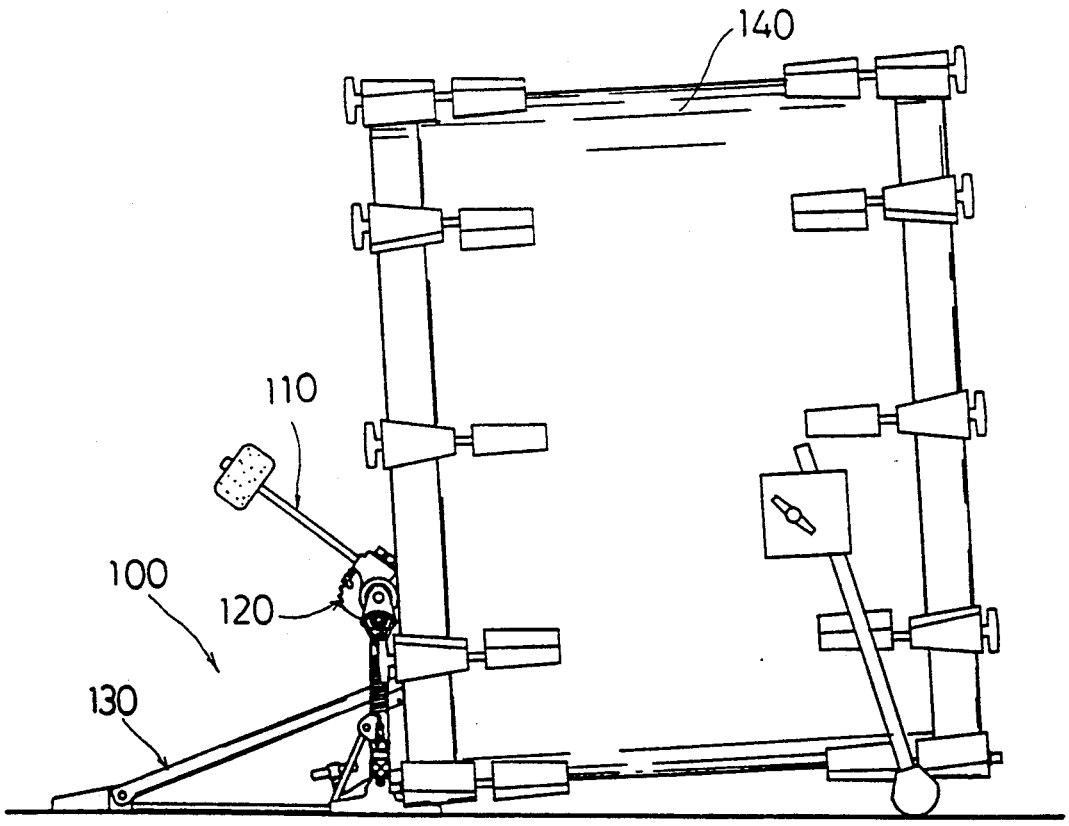
FIG. 10 PRIOR ART
FIG. 10 is a side view of a bass drum with an example of a beater of the drum pedal according to the prior art.
Figure 11:
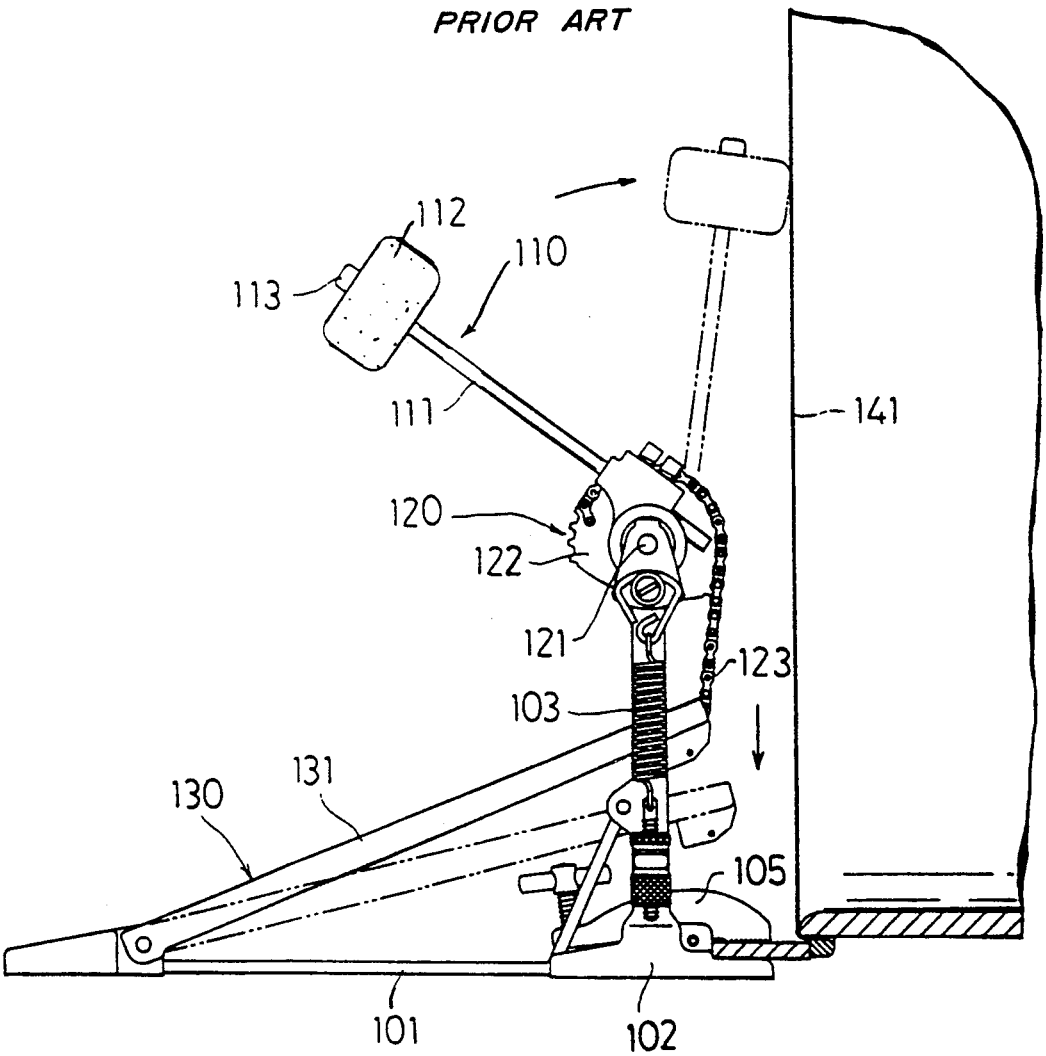
FIG.11 PRIOR ART
FIG. 11 is a side view of the beater of FIG. 10 with the drum pedal part expanded.

As shown in FIGS. 1 and 2, a first example of a beater 10 according to the invention is disposed on a conventional drum pedal 100, which is otherwise like the drum pedal shown in FIGS. 10 and 11. The beater beats the drum head 141 of the bass drum 140 with the entire beater surface of the main beating body 12 instead of striking the drum head with a point on an edge of the beater body. Structures used in FIGS. 1 and 2 and also in FIGS. 10 and 11 are indicated by the same numbers.

The beater 10 in FIGS. 1 and 2 comprises a rod 11 which supports a main beater body 12. The rod 11 has a holding shaft 13 formed on its tip. The shaft 13 extends transversely to the rod 11 and to the path of the swinging beater. The main beater body 12 is installed on the shaft 13 in such a manner as to be freely pivotable around the shaft, which serves as the axis of pivoting or swinging of the beater body. The bottom end of the rod 11 is fixed to the beater rotary shaft 121 through an installation member 30 located on the shaft 121. The shaft 121 serves as a pivot or swing axis for the rod 11. The axes 13 and 121 are parallel.

Figure 3:
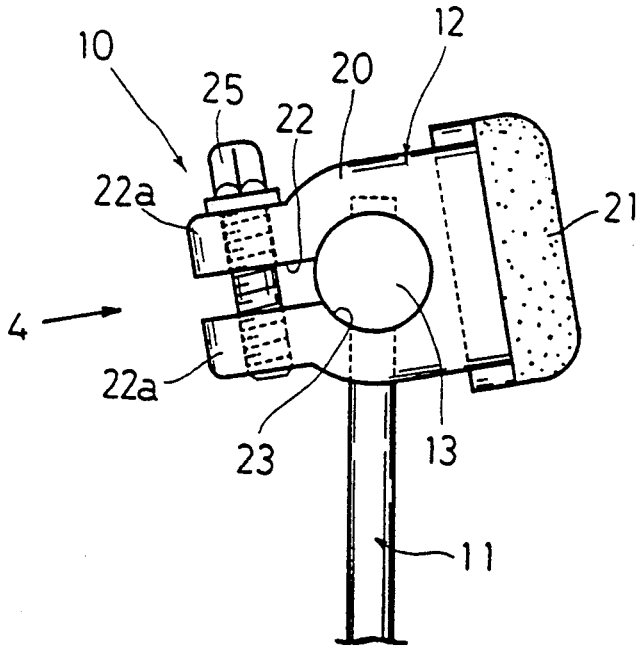
FIG. 3 is a side view of the essential part showing the structure of the beater head in FIG. 1.
Figure 4:
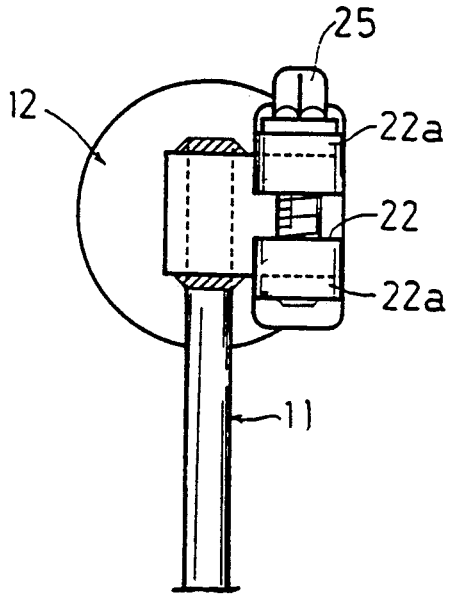
FIG. 4 is a view of the beater in the direction of the arrow in FIG. 3.
Figure 5:
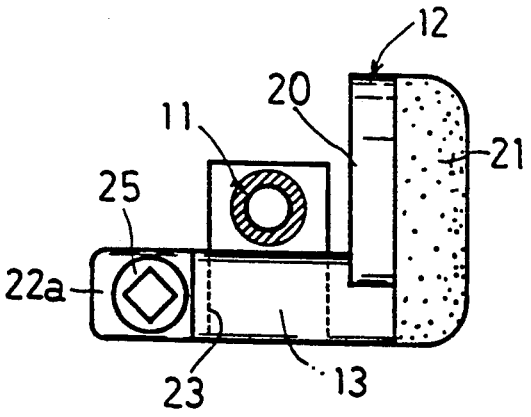
FIG. 5 is a plan view of the beater head of FIG. 3.
Figure 6:
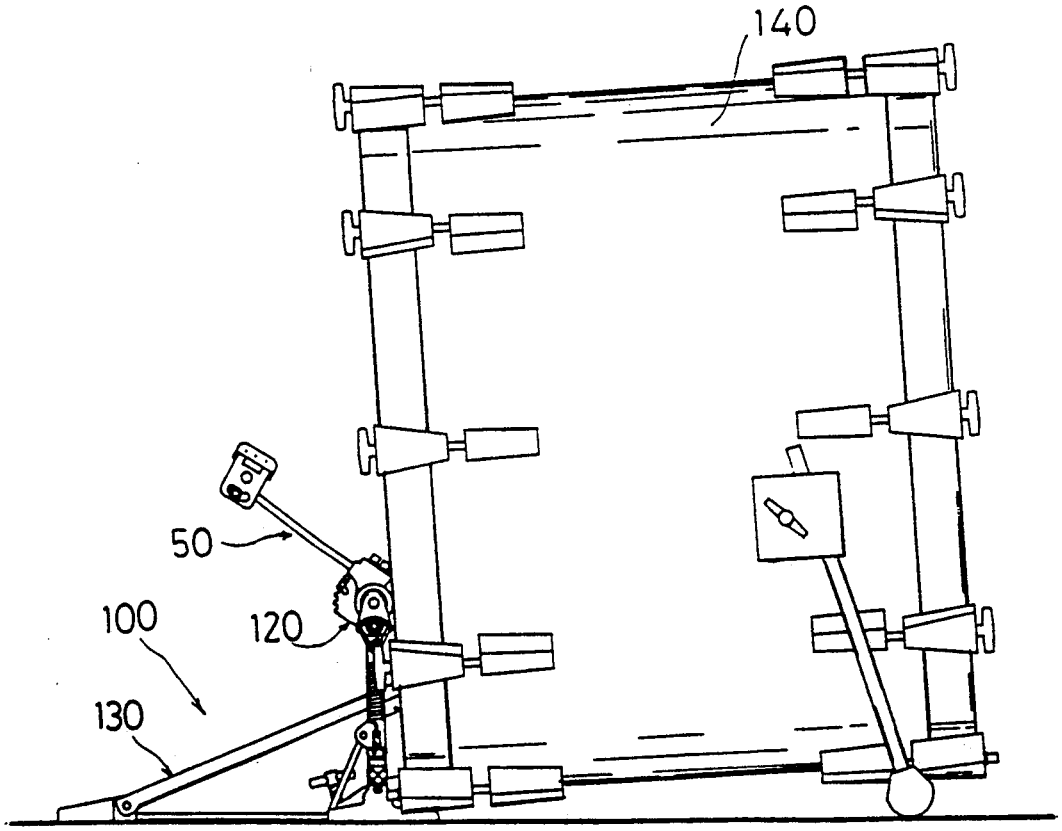
FIG. 6 is a side view of a drum pedal with a beater and showing another example of a beater head.
Figure 7:
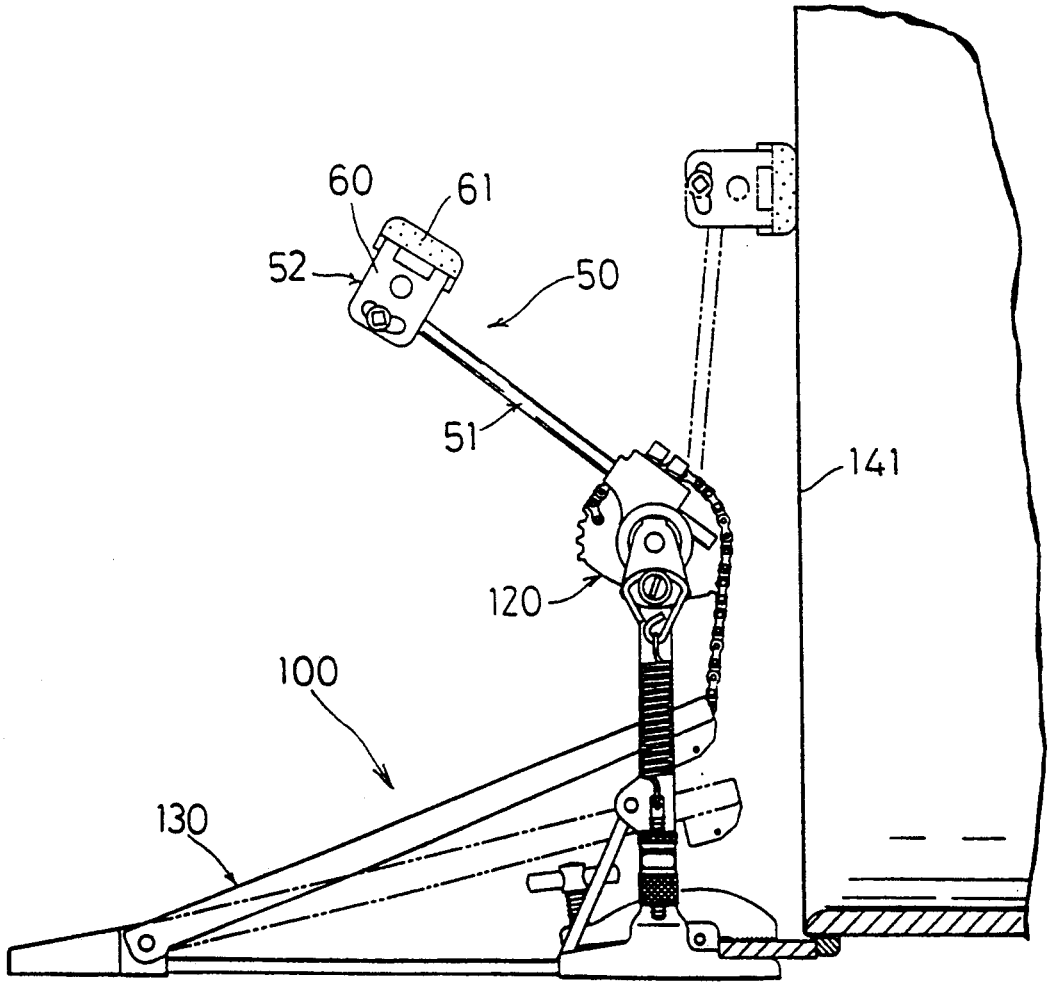
FIG. 7 is an expanded view of the beater of FIG. 6.

As is shown in FIGS. 3–5, the main beater body 12 comprises an installation part 20 and a beating part 21, which is made of felt, etc., which is formed on the front of the installation part 20. Away from the beating part 21, the installation part 20 has a divided or bifurcated part 22 which begins at a holding hole 23 in which the holding shaft 13 of the rod 11 is inserted.

The divided part 22 enables the main beater body 12 to be given an incline selected so that the beating part 21 of the main beating body 12 may beat the drum head flat on the surface of the beating part 21 at all times, irrespective of the incline or of the height position of the drum head with respect to the beater body. The main beater body 12 is adjusted to a suitable tilt angle. Then the ends 22*a* of the divided part 22 are tightened together and fixed by a tightening bolt 25 with a flange which engages the top end 22*a* and pulls it toward the bottom end 22*a* into which that bolt is threaded. This tightens the installation part 20 around the holding shaft 13 of the rod 11 compressively, causing the beating part 21 to be held at the desired angle.

FIGS. 6–9 show another example of a beater according to the invention. The same reference numbers as in FIGS. 10 and 11 indicate the same elements. A beater 50 includes a rod 51. A main beater body 52 has an installation part 60 which supports a beating part 61.

Figure 8:
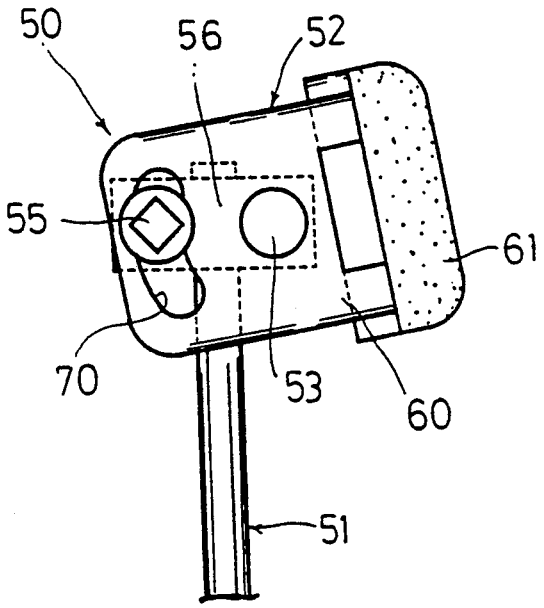
FIG. 8 is a side view of the essential part showing the beater head in FIG. 6.
Figure 9:
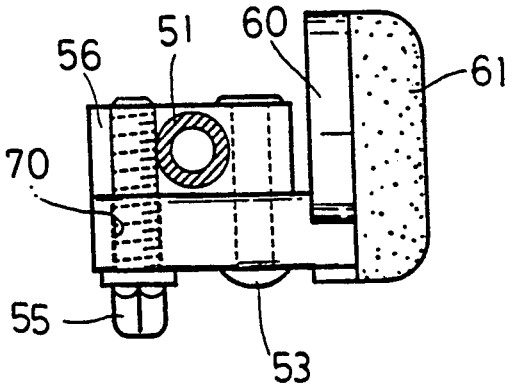
FIG. 9 is a plan view of the beater head in FIG. 6.

A holding shaft 53 is attached through a holding part 56 to the top end of the rod 51 and extends transversely to the rod, just like the shaft 13. The main beater body 52 is journaled freely rotatably on the holding shaft 53, as shown in FIGS. 8 and 9. A long, arc shaped groove 70 is provided in the installation part 60 of the main beater body 52. The arc has the holding shaft 53 of the rod 51 as its center of curvature. The groove 70 enables adjustment of the main beater body 52 at a suitable tilt angle, with respect to the rod 51, in order for the beater body front surface to beat flat against the drum head. Then the tightening bolt 55 by the holding part 56 and therefore by the rod 51 and passing through the arc shaped groove 70 is tightened against the main beater body part, thereby tightly fixing the beater body part at a selected orientation to the rod 51.

In the beater structure for the drum pedal according to the invention, the main beater body can be freely adjustably tilted, as compared with its support rod, and can then be fixed in a selected tilt orientation. As a consequence, irrespective of the position of the drum or of how the drum is combined with others in a drum set, the surface of the beating part of the beater can squarely beat the drum head surface, thereby obtaining a strong impact at the time of beating and producing a powerful sound quality.

By suitably changing the materials of the beating part of the main beater body such as by using rubber, plastics, etc., various sound qualities can be offered.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A beater for a drum pedal comprising:

a beater including a beater body, the beater body having a beating surface for beating a drum head;

a rod for supporting the beater body; a base to which the rod is supported for enabling the rod to swing toward and away from the drum head;

means for supporting the beater body on the rod away from the base, the supporting means enabling the beater body to be angularly adjusted with respect to the rod, and enabling the beating surface on the beater body to be adjusted to a selected orientation with respect to the drum head;

the rod being supported at the base for the rod to be swingable with respect to the base around a first axis, whereby the beater body on the rod is swingable toward and away from the drum head;

the supporting means including a second axis on the rod, the second axis being generally parallel to the first axis for swinging the beater body around the second axis, the second axis being spaced from the base and oriented to enable the orientation of the beater body to be adjusted around the second axis;

the supporting means including fixing means for enabling the beater body to be freely rotated around the second axis and for fixing the beater body at its selected orientation around the second axis;

wherein the beater body has a portion spaced away from the second axis and from the beating surface thereof, said beater body portion being divided into parts for receiving the second axis between the divided beater body parts, and the fixing means being operable for drawing the divdied beater body parts toward one another and against the second axis.

2. The beater of claim 1, further comprising a holding shaft supported on and extending transversely to the rod and defining the second axis, and the beater body being supported on the holding shaft.

3. The beater of claim 2, wherein the beater body portion is bifurcated to define the divided parts, and the fixing means for engaging and squeezing the bifurcated parts together on the holding shaft.

4. The beater of claim 3, wherein the fixing means comprises a bolt extending between the bifurcated beater body parts, such that tightening and loosening of the bolt fixed and releases the grip of the bifurcated parts on the holding shaft.

5. The beater of claim 1, further comprising an arc shaped pathway defined on the beater body and spaced away from the holding shaft, and the holding shaft being positioned at the center of curvature of the arc shaped pathway;

the fixing means being supported on the rod and being in contact with the beater body along the arc shaped pathway on the beater body, the beater body being pivotable with respect to the rod, and the fixing means selectively operable for fixing the beater body at a selected tilt orientation around the holding shaft.

6. A beater for a drum pedal comprising:

a beater including a beater body, the beater body having a beating surface for beating a drum head;

a rod for supporting the beater body; a base to which the rod is supported for enabling the rod to swing toward and away from the drum head;

means for supporting the beater body on the rod away from the base, the supporting means enabling the beater body to be angularly adjusted with respect to the rod, and enabling the beating surface on the beater body to be adjusted to a selected orientation with respect to the drum head;

the rod being supported at the base for the rod to be swingable with respect to the base around a first axis, whereby the beater body on the rod is swingable toward and away from the drum head;

the supporting means including a second axis on the rod, the second axis being generally parallel to the first axis for swing the beater body around the second axis, the second axis being spaced from the base and oriented to enable the orientation of the beater body to be adjusted around the second axis;

the supporting means including fixing means for enabling the beater body to be freely rotated around the second axis and for fixing the beater body at a selected orientation around the second axis;

an arc shaped pathway defined on the beater body and spaced away from the second axis, and the second axis being positioned at the center of curvature of the arc shaped pathway;

the fixing means being supported on the rod and being in contact with the beater body along the arc shaped pathway on the beater body, the beater body being pivotable with respect to the rod, and the fixing means being selectively operable for drawing the beater body and supporting means together, to fix the beater body at a selected tilt operation around the holding shaft;

an arc shaped slot in the beater body defining the arc shaped pathway on the beater body.

7. The beater of claim 6, wherein the fixing means comprises a bolt which is supported on the rod and which extends into the groove in the beater body and the bolt being tightenable to the beater body for holding the beater body at a selected orientation around the holding shaft.

8. The beater of claim 6, further comprising a holding shaft supported on and extending transversely to the rod and defining the second axis, and the beater body being supported on the holding shaft.

* * * * *